US009961962B2

(12) United States Patent
Lee

(10) Patent No.: US 9,961,962 B2
(45) Date of Patent: May 8, 2018

(54) ARTICLE OF FOOTWEAR HAVING ACTIVE REGIONS AND SECURE REGIONS

(71) Applicant: ACTION SPORTS EQUIPMENT, INC., Fullerton, CA (US)

(72) Inventor: Sang Jeong Lee, Fullerton, CA (US)

(73) Assignee: ACTION SPORTS EQUIPMENT INC., Fullerton, CA (US)

( * ) Notice: Subject to any disclaimer, the term of this patent is extended or adjusted under 35 U.S.C. 154(b) by 89 days.

(21) Appl. No.: 14/829,166

(22) Filed: Aug. 18, 2015

(65) Prior Publication Data

US 2017/0049186 A1 Feb. 23, 2017

(51) Int. Cl.

| | |
|---|---|
| ***A43B 1/04*** | (2006.01) |
| ***A43B 23/02*** | (2006.01) |
| ***A43B 5/00*** | (2006.01) |
| ***A43B 23/04*** | (2006.01) |

(52) U.S. Cl.

CPC ..... *A43B 23/027* (2013.01); *A43B 1/04* (2013.01); *A43B 5/002* (2013.01); *A43B 23/02* (2013.01); *A43B 23/028* (2013.01); *A43B 23/0215* (2013.01); *A43B 23/0265* (2013.01); *A43B 23/0275* (2013.01); *A43B 23/042* (2013.01)

(58) Field of Classification Search

CPC ..... A43B 5/002; A43B 5/003; A43B 13/146; A43B 23/0265; A43B 23/027; A43B 23/0275; A43B 23/028

USPC ..... 36/45, 48, 103

See application file for complete search history.

(56) References Cited

U.S. PATENT DOCUMENTS

| | | | | |
|---|---|---|---|---|
| 5,142,797 | A | 9/1992 | Cole, III | |
| 5,377,430 | A * | 1/1995 | Hatfield | A43B 3/08 24/714.6 |
| 6,108,943 | A * | 8/2000 | Hudson | A43B 5/10 36/102 |
| 6,910,288 | B2 | 6/2005 | Dua | |
| 6,986,269 | B2 * | 1/2006 | Dua | A43B 1/04 66/177 |
| 7,774,956 | B2 * | 8/2010 | Dua | A43B 1/04 36/45 |
| 8,806,776 | B2 * | 8/2014 | Leick | A43B 1/0081 12/142 LC |
| 9,259,054 | B2 * | 2/2016 | Nishiwaki | A43B 23/0255 |
| 2002/0100188 | A1 | 8/2002 | Jacques et al. | |
| 2003/0106243 | A1 | 6/2003 | Tucker | |

(Continued)

FOREIGN PATENT DOCUMENTS

WO WO 2015/038344 A1 3/2015

OTHER PUBLICATIONS

Partial European Search Report dated Jan. 18, 2017, issued to European Application No. 16159041.9-1555.

*Primary Examiner* — Sharon M Prange

(74) *Attorney, Agent, or Firm* — Stein IP, LLC

(57) ABSTRACT

An article of footwear for climbing is disclosed. The article of footwear includes a sole structure including at least an outsole and having a concave shape; and an upper secured to the sole structure. The upper includes a textile including an active region and a secure region, the active region being between a lateral side of the upper and a medial side of the upper at least in an area of the upper at a toe side of an area corresponding to a ball of a foot disposed in the article of footwear. The article of footwear provides for stretchability in the active region and support in the secure region.

6 Claims, 7 Drawing Sheets

(56) References Cited

U.S. PATENT DOCUMENTS

| | | | | |
|---|---|---|---|---|
| 2004/0111921 | A1 | 6/2004 | Lenormand | |
| 2004/0118018 | A1 | 6/2004 | Dua | 36/45 |
| 2005/0115284 | A1 | 6/2005 | Dua | |
| 2006/0130359 | A1 | 6/2006 | Dua | |
| 2012/0255201 | A1 | 10/2012 | Little | |
| 2012/0304503 | A1 | 12/2012 | Bouvet et al. | |
| 2013/0212905 | A1 | 8/2013 | Hazenberg et al. | |
| 2013/0232815 | A1 | 9/2013 | Meythaler et al. | |
| 2013/0269212 | A1 | 10/2013 | Little | |
| 2014/0026438 | A1 | 1/2014 | Cortez et al. | |
| 2014/0237858 | A1* | 8/2014 | Adami | A43B 23/0205 36/107 |
| 2014/0310983 | A1 | 10/2014 | Tamil et al. | |
| 2014/0310984 | A1 | 10/2014 | Tamm et al. | |
| 2014/0310986 | A1 | 10/2014 | Tamm et al. | |
| 2014/0338226 | A1 | 11/2014 | Zavala | |
| 2015/0013187 | A1* | 1/2015 | Taniguchi | A43B 1/04 36/84 |
| 2015/0047225 | A1 | 2/2015 | Zavala et al. | |
| 2015/0059209 | A1 | 3/2015 | Dekovie et al. | |
| 2015/0095271 | A1 | 4/2015 | Ioannidis et al. | |
| 2015/0101212 | A1 | 4/2015 | Dekovie et al. | |
| 2015/0289595 | A1* | 10/2015 | Rushbrook | A43C 11/22 36/50.1 |
| 2016/0174660 | A1* | 6/2016 | Iuchi | A43B 1/04 36/45 |

* cited by examiner

ARTICLE OF FOOTWEAR HAVING ACTIVE REGIONS AND SECURE REGIONS

BACKGROUND OF THE INVENTION

1. Field of the Invention

The present disclosure relates to an article of footwear and, more particularly, to an article of footwear having active and secure regions providing for a flexible, breathable, and comfortable shoe that remains appropriately secured to a foot during application of loads on the article.

2. Description of the Related Art

Articles of footwear, commonly referred to as shoes, have become increasingly specialized for intended uses. FIG. 1 illustrates an article of footwear according to the related art. The article of footwear may be, for example, a shoe 10 designed to be worn by a user engaged in climbing sports, such as indoor climbing or rock climbing. The shoe 10 includes an upper 20 and an outsole 30 attached to each other to define the general shape of the shoe 10. The upper 20 may be formed of several parts attached to each other to cover a foot and may include, for example, reinforced lips 70, a tongue 60 attached in at least a toe area and disposed between the reinforced lips 70 to cover a top of a foot, and eyelets 82 formed in the reinforced lips 70. Laces 80 may be threaded through the eyelets 82 of the reinforced lips 70 and extend over the tongue 60 to tighten and secure the upper 20 of the shoe 10 about a foot of a user.

The upper 20 may further include a rand 40 and a heel counter 50. The rand 40 may be disposed from a medial to a lateral side of the upper 20 about a toe region of the shoe 10 to protect the upper 20 from abrasion and provide slip-resistant traction for various climbing maneuvers. The rand 40 may extend around a heel region of the upper 20 and up the heel region of the upper 20. The heel counter 50 may be disposed from the medial to the lateral side of the upper 20 about a heel region of the shoe 10 and extend to at least partially cover the rand 40 to secure and support a heel of a foot disposed in the shoe 10. The heel counter 50 may be formed of stretch-resistant material. The upper 20 may be attached to an insole, not shown, by stitching or sewing or the upper 20 may be directly attached to the outsole 30 by stitching, sewing, adhesives, or the like. The outsole 30 may be made of an abrasion and slip-resistant rubber or the like.

The conventional climbing shoe 10 is designed to have a very tight fit such that a foot disposed therein does not move relative to the shoe 10. Therefore, it is generally preferred that the upper 20 for the shoe 10 be made of inelastic, stretch-resistant materials. Further, the material of the upper 20 is generally designed and selected to resist stretching so that a foot disposed inside the shoe 10 is securely held. The upper 20 may be formed of natural or synthetic materials, and most climbing shoes utilize a natural leather or a synthetic leather simulation, for example, split-grain leather, suede leather, resin-treated material, microfiber, and the like. Further, the upper 20 may be internally lined with additional natural or synthetic materials, for example, foam padding or the like.

However, the use of such materials as an upper 20 substantially decreases the breathability of the upper 20 and the shoe 10. When a wearer of the shoe 10 is under stress or exertion, such materials may contribute to perspiration of the wearer's foot disposed in the shoe 10, which may result in the wearer's foot slipping within the shoe 10. Moreover, the combination of such materials and perspiration result in the shoe 10, over time, smelling terrible, which is a well-known problem within the climbing community.

Further, because of the inelasticity or resistance to stretching of the conventional materials used to form the upper 20, movement of a foot disposed in the shoe 10 may be uncomfortable or even painful. For example, in moving through various climbing maneuvers, a climber may move the toes of the foot from a low tension state, to a medium tension state, and to a high tension state depending upon weight and forces applied to the feet and the features of the structure being climbed. Generally, because of the inelasticity of the conventional materials, climbing shoes are designed as low tension shoes, medium tension shoes, and high tension shoes. Such different types of shoes do not individually accommodate the various foot and toe positions used in climbing well such that different shoes may be preferred for different climbs, routes, surfaces, features, and the like.

SUMMARY OF THE INVENTION

Aspects of the present invention are directed to an article of footwear, including: a sole structure comprising at least an outsole and having a concave shape; and an upper secured to the sole structure comprising a textile comprising an active region and a secure region, the active region being between a lateral side of the upper and a medial side of the upper at least in an area of the upper at a toe side of an area corresponding to a ball of a foot disposed in the article of footwear.

In the article of footwear of according to aspects of the present invention, the active region is elastically stretchable in at least one direction.

In the article of footwear of according to aspects of the present invention, the at least one direction is a transverse direction of the article of footwear.

In the article of footwear of according to aspects of the present invention, the area of the upper at the toe side of the area corresponding to the ball of the foot disposed in the article of footwear is a knuckle box of the article of footwear.

In the article of footwear of according to aspects of the present invention, the upper further includes an active region at the lateral side of the article of footwear and an active region at the medial side of the article of footwear.

In the article of footwear of according to aspects of the present invention, the active region at the lateral side and the active region at the medial side each extend in a direction between the sole structure and a top portion of the upper and are elastically stretchable in a longitudinal direction of the article of footwear.

In the article of footwear of according to aspects of the present invention, the active region at the lateral side and the active region at the medial side are each elastically stretchable in a transverse direction of the article of footwear.

In the article of footwear of according to aspects of the present invention, the upper is a unitary textile upper.

In the article of footwear of according to aspects of the present invention, the upper further comprises a tongue portion at a top portion of the upper, and the tongue portion comprises an active region elastically stretchable in at least a transverse direction of the article of footwear.

In the article of footwear of according to aspects of the present invention, the secure region is disposed about a heel region of the upper.

In the article of footwear of according to aspects of the present invention, the secure region extends farther along the lateral side of the upper than along the medial side of the upper.

In the article of footwear of according to aspects of the present invention, the active region comprises a first portion having a first elastic stretchability and a second portion having a second elastic stretchability, the first elastic stretchability and the second elastic stretchability being different.

In the article of footwear of according to aspects of the present invention, the upper further comprises an opening through which a foot is extendable, the opening being at least partially bound by an elastically stretchable active region.

In the article of footwear of according to aspects of the present invention, the secure region comprises one continuous area formed or disposed about the entirety of the upper.

In the article of footwear of according to aspects of the present invention, the continuous area of the secure region extends farther along a lateral edge of the lateral side of the upper than along a medial edge of a medial side of the upper.

In the article of footwear of according to aspects of the present invention, in a midfoot region of the upper, the continuous area of secure region formed or disposed toward a top portion of the upper on both the lateral and medial sides of the upper.

In the article of footwear of according to aspects of the present invention, the upper further comprises an active region in the midfoot region between the secure region and a lateral edge of the upper and an active region in the midfoot region between the secure region and a medial edge of the upper.

In the article of footwear of according to aspects of the present invention, the upper comprises 52-60% polyester, 20-28% nylon, and 16-24% hot melt yarn by mass.

Aspects of the present invention are directed to an article of footwear, including: a sole structure comprising at least an outsole; and an upper secured to the sole structure comprising a textile comprising an active region and a secure region, the secure region being disposed about a heel region of the upper and extending farther along a lateral side of the upper than along a medial side of the upper.

In the article of footwear of according to aspects of the present invention, the active region is between the lateral side of the upper and the medial side of the upper at least in an area of the upper at a toe side of an area corresponding to a ball of a foot disposed in the article of footwear.

In the article of footwear of according to aspects of the present invention, the upper comprises 52-60% polyester, 20-28% nylon, and 16-24% hot melt yarn by mass.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings.

DETAILED DESCRIPTION OF THE EMBODIMENTS

Figure 1:
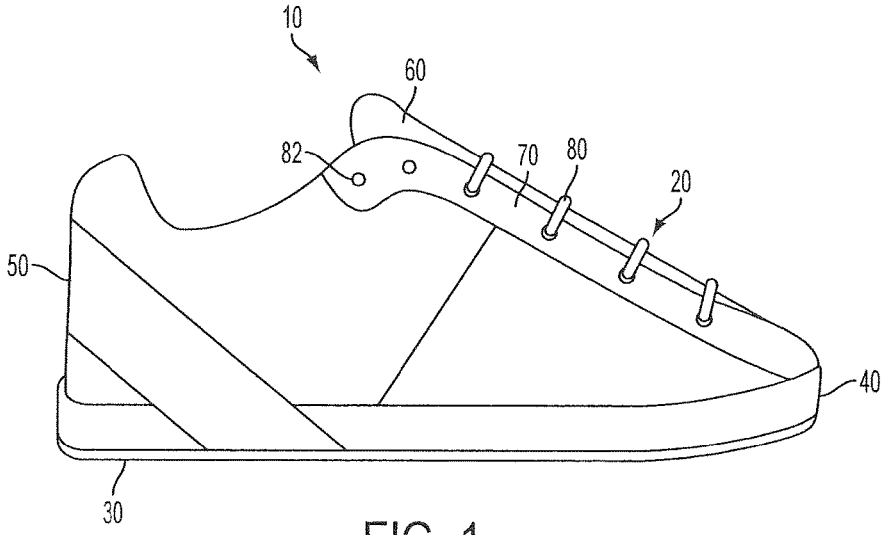
FIG. 1 RELATED ART
FIG. 1 illustrates an article of footwear according to the related art.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

As used herein, a "'" symbol following a reference numeral indicates that the feature is formed or disposed in a medial side of the article of footwear, and the absence of the "'" symbol after a reference numeral indicates that the feature is formed or disposed on a lateral side of the article of footwear or is visible from or extends between both the medial and the lateral sides of the article of footwear.

Figure 2:
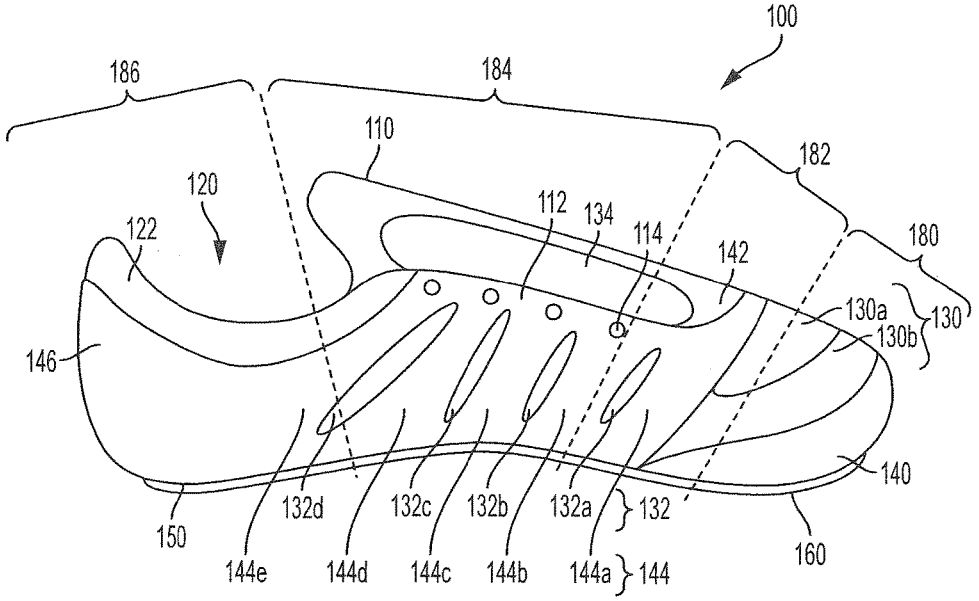
FIG. 2 is a side view of an upper for article of footwear according to aspects of the present invention.
Figure 3:
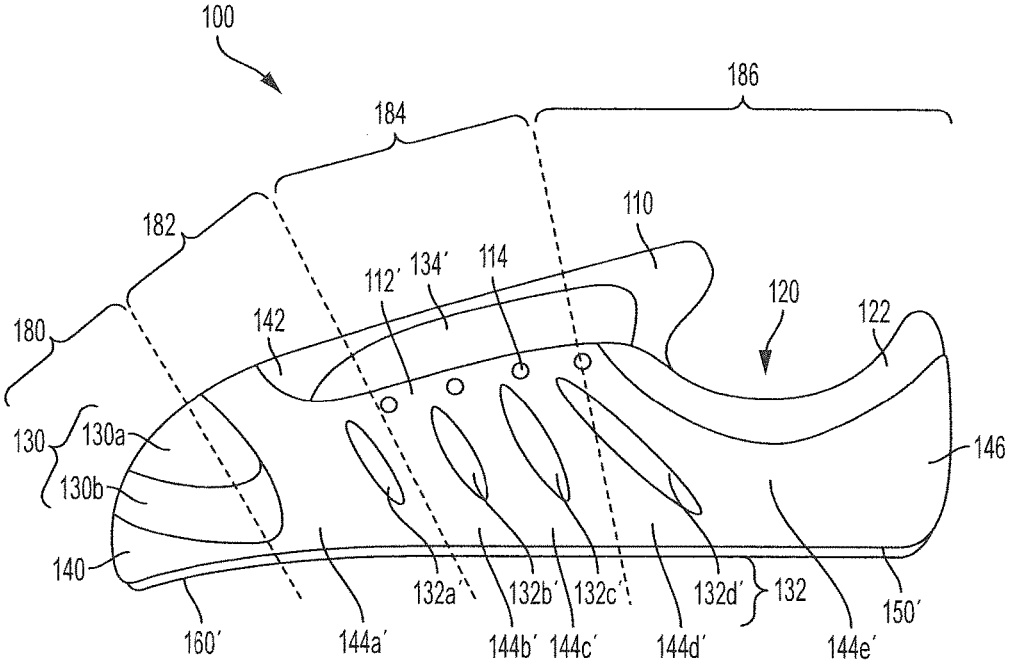
FIG. 3 is a side view of an upper for article of footwear according to aspects of the present invention.
Figure 4:
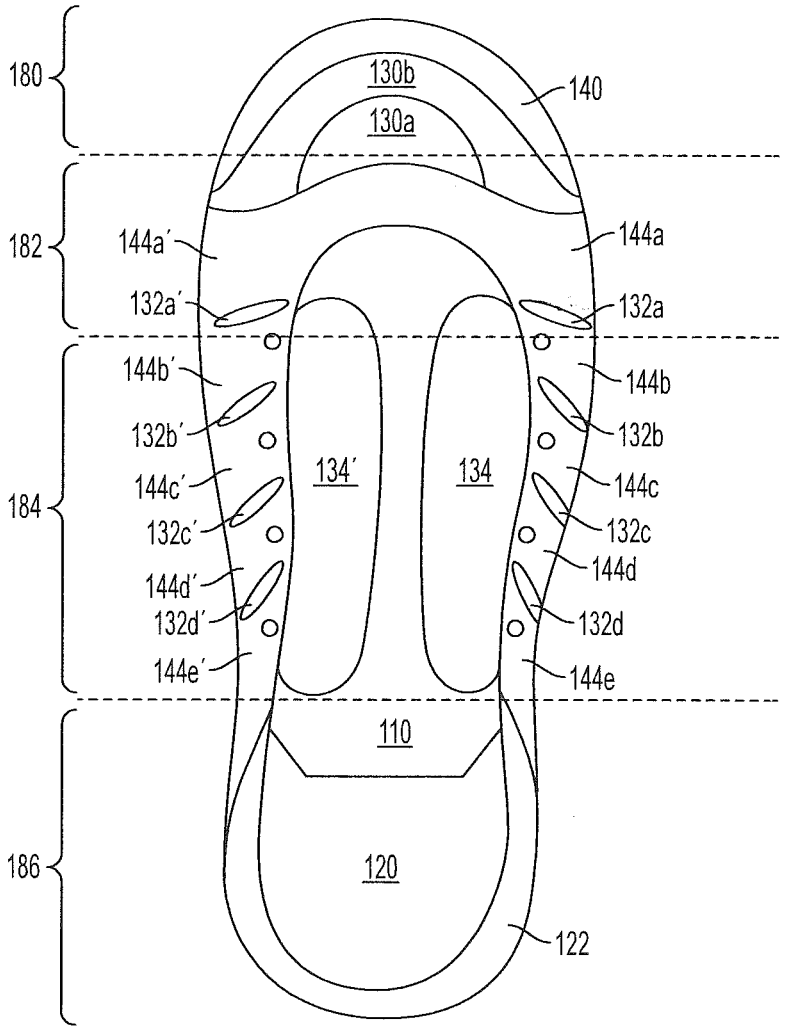
FIG. 4 is a top view of an upper for article of footwear according to aspects of the present invention.

FIG. 2 is a side view of an upper for article of footwear according to aspects of the present invention, FIG. 3 is a side view of an upper for article of footwear according to aspects of the present invention, and FIG. 4 is a top view of an upper for article of footwear according to aspects of the present invention. Anatomically, feet generally come in pairs and are reflections of each other such that a left foot is a reflection of a right foot. As such, FIG. 2 is, more specifically, a lateral side view of an upper for an article of footwear for a right foot, and FIG. 3 is, more specifically, a medial side view of an upper for an article of footwear for a right foot. It should be understood that aspects described herein are equally applicable to articles of footwear shaped for left feet and shaped for right feet. Articles of footwear are generally referred to as shoes.

FIGS. 2, 3, and 4 illustrate an upper 100 for a shoe according to aspects of the present invention. A shoe generally includes an upper attached to a sole structure, including, for example, a midsole and an outsole 160, to at least partially enclose a foot disposed therein.

And, generally, multiple pieces of material are attached together to form an upper for a shoe. Here, the upper 100 may be formed as a one-piece upper and may have one or fewer seams in which one or more portions of textile come together to be attached via sewing or bonding. For example, the upper 100 may be formed of a textile to have a bootie construction or a sock-like construction. The bootie construction or the sock-like construction may be a knit construction formed via circular knitting, for example, by a circular knitting machine. Or, for example, the upper 100 may be knitted to form a unitary upper to wrap from a heel region, along a medial region, about a toe region, along a lateral region, and to the heel region again to be joined in the heel region by one seam. Further, the upper 100 may be of a unitary construction and include more than one seam. The upper 100 may be one piece and include stitching to connect different portions of the upper 100 to the upper 100, for example, when a portion of the upper 100 overlaps another portion of the upper 100. Aspects of the present invention provide for the upper 100 to be of knitted construction, which substantially increases breathability of the shoe including the upper 100 with respect to the materials of the uppers of the related art. Such increased breathability decreases the incidence of smell of the shoe including the upper 100.

Further, the upper 100 may be made or knit from different yarns or threads including, for example, nylon, polyester, thermoplastics, hot melt yarn, and the like. For example, the upper 100 may be 52-60% polyester, 20-28% nylon, and 16-24% hot melt yarn by mass.

As shown in FIGS. 2, 3, and 4, the upper 100 includes a toe region 180, a forefoot (ball) region 182, a midfoot (arch) region 184, and a heel region 186. The upper 100 forms a toe box to house toes of a foot disposed in the upper 100 in the toe region 180. The forefoot region 182 is disposed between the toe region 180 and the midfoot region 184 and generally corresponds to a portion of a foot disposed in a shoe including the upper 100 in which the toes join the rest of the foot. In other words, the forefoot region 182 corresponds, generally, to a portion of the upper 100 in which the metatarsophalangeal articulations of a foot disposed in a shoe including the upper 100 are located. The forefoot region 182 may include an region corresponding to a location of the ball of a foot disposed in the upper 100, and a boundary between the toe region 180 and the forefoot region 182 may be at or about a toe-side of the ball of a foot disposed in the upper 100.

The midfoot region 184 is disposed between the forefoot region 182 and the heel region 186 and generally corresponds to a portion of the upper 100 in which an arch of a foot disposed in a shoe including the upper 100 is located. The heel region 186 of the upper 100 is disposed adjacent to the midfoot region 184 and at an opposite end of the upper 100 from the toe region 180 in a lengthwise direction of the upper 100.

The upper 100 includes a tongue portion 110 to cover a top of a foot disposed in the upper 100 and an opening 120 through which a foot is disposable. The tongue portion 110 may be integrally formed with the other portions of the upper 100 and may be secured at a base of the tongue portion 110 nearest the toe region 180 or may be secured along one or more lip portions 112 of the upper 100. The lip portions 112 may include eyelets 114 through which laces may be threaded so as to extend over the tongue portion 110 to opposing eyelets 114', shown in FIG. 3, to aid in securing the upper 100 to a foot disposed therein. A distal portion of the tongue portion 110 nearest the heel region 186 cooperates with a cuff region 122 to complete the opening 120 through which a foot is disposable.

As shown in FIG. 2, various active regions 130, 132, and 134 and secure regions 140, 142, 144, and 146 are formed or disposed in the lateral side of the upper 100, and, as shown in FIG. 3, various active regions 130, 132', and 134' and secure regions 140, 142, 144', and 146 are formed or disposed in the medial side of the upper 100. The active regions 130, 132, 132', 134, and 134' have different properties than the secure regions 140, 142, 144, 144', and 146 so as to provide comfort and flexibility via the active regions 130, 132, 132', 134, and 134' and stability and support via the secure regions 140, 142, 144, 144', and 146. The active regions 130, 132, 132', 134, and 134' may be formed to have greater, for example, elasticity, flexibility, and/or breathability, and/or lesser resistance to stretching, bending, twisting, and the like relative to the secure regions 140, 142, 144, 144', and 146. The secure regions 140, 142, 144, 144', and 146 may be formed to have greater, for example, stretch-resistance, abrasion-resistance, stability, support, durability, stiffness, and the like relative to the active regions 130, 132, 132', 134, and 134'. The active regions 130, 132, 132', 134, and 134' may be elastically stretchable and/or flexible in one, two, three, or more directions according to, for example, a weave, a knit, and/or strands of the material of the upper 100, and may be sufficiently elastic and/or resilient to return to an original shape or state when a deforming object is removed and may be sufficiently elastic to resist stretching so as to hold or secure a deforming object deforming the active regions 130, 132, 132', 134, and 134'.

The active regions 130, 132, 132', 134, and 134' and the secure regions 140, 142, 144, 144', and 146 may be formed by differences in elasticity, resilience, breathability, and/or resistance to stretching due to, for example, differences in materials, density, weave, knitting, heating, bonding, pressing, and the like of the active regions 130, 132, 132', 134, and 134' and secure regions 140, 142, 144, 144', and 146 of the upper 100. For example, the strands knit to form the upper 100 may include a thermoplastic polymer or hot melt material such that, when heated, the thermoplastic polymer or hot melt material fuses with strands knit to form the secure regions 140, 142, 144, 144', and 146 of the upper 100. Different strands may be included in different regions or throughout the material of the upper 100. For example, the upper 100 may include thermoplastic polymer strands or hot melt yarns throughout the entirety of the upper 100 such that only portions of the upper 100 corresponding to the secure regions 140, 142, 144, 144', and 146 are heated, pressed, or the like to form the secure regions 140, 142, 144, 144', and 146, or the upper 100 may include thermoplastic polymer strands or hot melt yarns only in regions of the upper 100 corresponding to the secure regions 140, 142, 144, 144', and 146 so that the entire upper 100 may be heated, pressed, or the like to form the secure regions 140, 142, 144, 144', and 146.

In FIGS. 2, 3, and 4, the active region 130 may be disposed in a toe box in the toe region 180 and forefoot region 182 of the upper 100. For example, the active region 130 may be disposed in a transverse direction of a shoe including the upper 100 from a lateral edge 150 of the upper 100 over a foot disposed in the upper 100, adjacent to the base of the tongue portion 110, to a medial edge 150' of the upper 100 shown in FIG. 3. The active region 130 may provide for a decreased resistance to stretching or allows for stretching and/or flexibility across and above a foot disposed in the upper 100 along at least the transverse direction between the lateral edge 150 and the medial edge 150' of the upper 100 at about the toe-side of the ball of a foot disposed in the upper 100, i.e., the area of the upper 100 commonly referred to as the knuckle box may be elastically stretchable to accommodate a foot disposed therein in a high tension state. The toe-side of the ball of the foot disposed in the upper 100 may be a transition between the toe region 180 and the forefoot region 182. Such stretching and/or flexibility provides for a comfortable fit when a wearer of the upper 100 as part of a shoe transitions the foot from a low tension state to a medium tension state, and/or from a medium tension state to a high tension state as the upper 100 of the shoe remains supportive but allows for a relatively increased height of the foot within the upper 100. Further, the active region 130 may be elastically stretchable and/or flexible in a longitudinal direction, e.g., a direction between the toe region 180 and the heel region 186, or other direction of the upper 100 to provide for additional flexibility of the active region 130.

The active region 132 is formed or disposed along a lateral side of the upper 100 as shown in FIG. 2, and the active region 132' is formed or disposed along a medial side of the upper 100 as shown in FIG. 3. The active regions 132 and 132' may include one or more separate portions. For example, the active region 132 may include a first portion 132*a*, a second portion 132*b*, a third portion 132*c*, and a fourth portion 132*d* disposed along the lateral side of the upper 100 between the lip 112 and the lateral edge 150 of the upper 100. Similarly, the active region 132' may include a first portion 132*a*', a second portion 132*b*', a third portion 132*c*', and a fourth portion 132*d*' disposed along the medial side of the upper 100 between the lip 112' and the medial edge 150' of the upper 100.

The first portion 132*a* of the active region 132 on the lateral side of the upper 100 as shown in FIG. 2 and the first portion 132*a*' of the active region 132 on the medial side of the upper 100 as shown in FIG. 3 may be formed or disposed in a forefoot region 182 of the upper 100 and may be the closest to the toe region 180 of the upper 100 among the remaining portions of the active regions 132 and 132'. The fourth portions 132*d* and 132*d*' of the active regions 132 and 132', respectively, may be formed or disposed in a midfoot region 184 and/or in a heel region 186 of the upper 100. For example, the fourth portion 132*d* of the active region 132 and the fourth portion 132*d*' of the active region 132' may be formed or disposed to cross between the midfoot region 184 and the heel region 186 of the upper 100. And, the second portion 132*b* and the third portion 132*c* of the active region 132 may be disposed between the first portion 132*a* and the fourth portion 132*d* and may be disposed in the midfoot region 184 of the upper 100 between the lip 112 and the lateral edge 150 of the upper 100. Similarly, the second portion 132*b*' and the third portion 132*c*' of the active region 132' may be disposed between the first portion 132*a*' and the fourth portion 132*d*' and may be disposed in the midfoot region 184 of the upper 100 between the lip 112' and the medial edge 150' of the upper 100. Although the active regions 132 and 132' are described as having first to fourth portions 132*a*-132*d* and 132*a*'-132*d*', aspects need not be limited thereto such that the active regions 132 and 132' may have more or fewer individual portions disposed along the lateral side of the upper 100. Further, the active regions 132 and 132' along the lateral and medial sides of the upper 100, respectively, may include different numbers of portions. For example, the active region 132 along the lateral side of the upper 100 may include 5 portions while the active region 132' along the medial side of the upper 100 may include 3 portions.

The active regions 134 and 134' are formed or disposed in a longitudinal direction of the upper 100 in the tongue 130 between the base and the distal portion of the tongue portion 110. The active region 134 may be formed or disposed in a lateral side of the tongue portion 110 between a center of the tongue portion 110 and the lip 112 of the upper 100. The active region 134' may be similarly formed or disposed in a medial side of the tongue portion 110 between a center of the tongue portion 110 and the lip 112' of the upper 100. Although shown as separate, active regions 134 and 134' need no be limited thereto such that the tongue 130 may only have one active region or the active regions 134 and 134' may be connected.

The active regions 134 and 134' may be attached to the lips 112 and 112', respectively, or may be separate therefrom and may provide for further stretching of the upper 100 in a transverse direction of the upper 100, generally perpendicular to the longitudinal direction of the upper 100. The stretching of the upper 100 in the transverse direction provides for a comfortable fit when a wearer of the upper 100 as part of a shoe transitions the foot from a low tension state, to a medium tension state, and/or from a medium tension state to a high tension state as the upper 100 of the shoe remains supportive but allows for a relatively increased height of the foot within the upper 100.

The opening 120 of the upper 100 is bound by the distal portion of the tongue portion 110 and the cuff region 122. The cuff region 122 may be an additional active region elastically stretchable or having a relatively lower resistance to stretch to allow for a foot to be disposed therethrough to enter a shoe having the upper 100 as well as to return to a previous shape of the cuff region 122 to aid in securing the upper 100 of the shoe to the foot disposed therein. The cuff region 122 may have a greater ability to stretch than other active regions of the upper 100.

The secure region 140 may be formed or disposed about a toe box in a toe region 180 of the upper 100 and may extend into the forefoot region 182 of the upper 100 on at least one of the lateral and medial sides of the upper 100. The secure region 140 may secure the toes of a foot disposed in the upper 100 when the toes are, for example, in a low tension state. The secure region 140 may provide for abrasion resistance and resistance to stretching to extend the life of the shoe including the upper 100. Further, a rand or a portion of an outsole 160 may be disposed to cover at least a portion of the secure region 140 to provide for more abrasion resistance and/or traction when climbing.

Remaining in FIGS. 2, 3, and 4, the secure region 142 may be formed or disposed in a longitudinal direction of the upper 100 in the tongue 130 between the base and the distal portion of the tongue portion 110. The secure region 142 may extend along a center of the tongue 130 and may surround the active regions 134 and 134' to be attached to the lips 112 and 112' of the upper 100. However, aspects need not be limited thereto such that the secure region 142 need not surround the active regions 134 and 134' such that the active regions 134 and 134' may be attached to the lips 112 and 112', respectively, of the upper 100 or the tongue need not be attached to the lips 112 and 112' of the upper 100.

The secure region 144 is formed or disposed along the lateral side of the upper 100 as shown in FIG. 2, and the secure region 144' is formed or disposed along the medial side of the upper 100 as shown in FIG. 3. The secure regions 144 and 144' may include one or more separate portions. For example, the secure region 144 may include a first portion 144*a*, a second portion 144*b*, a third portion 144*c*, a fourth portion 144*d*, and a fifth portion 144*e*, and the secure region 144' may include a first portion 144*a*', a second portion 144*b*', a third portion 144*c*', a fourth portion 144*d*', and a fifth portion 144*e*'. The first portions 144*a* and 144*a*' of the secure regions 144 and 144', respectively, may be formed or disposed between the active region 130 and the first portions 132*a* and 132*a*' of the active regions 132 and 132', respectively. The first to fifth portions 144*a*-144*e* of the secure region 144 may be formed or disposed alternately with respect to the first to fourth portions 132*a*-132*d* of the active region 132 as shown in FIG. 2, and the first to fifth portions 144*a*'-144*e*' of the secure region 144' may be formed or disposed alternately with respect to the first to fourth portions 132*a*'-132*d*' of the active region 132' as shown in FIG. 3. The fifth portions 144*e* and 144*e*' of the secure regions 144 and 144' may be formed or disposed between the fourth portions 132*d* and 132*d*' of the active regions 132 and 132', respectively, and the secure region 146. The alternate arrangement of the portions of the secure regions 144 and 144' and the active regions 132 and 132', respectively, along the lateral and medial sides of the upper 100 provides for vertical stability between the lips 112 and 112' and the lateral and medial edges 150 and 150' of the upper 100 due to the high resistance to stretching of the secure regions 144 and 144'. Further, the alternate arrangement of the portions of the secure regions 144 and 144' and the active regions 132 and 132' along the lateral and medial sides of the upper 100 provides longitudinal flexibility and compliance along the lateral side of the upper 100 due to the lower resistance to stretching of the active regions 132 and 132'.

Further, the eyelets 114 and 114' may be aligned with at least one of the first to fifth portions 144*a*-144*e* and 144*a*'-144*e*' of the secure regions 144 and 144' so as to provide a stretch resistant path between the lips 112 and 112' and the lateral and medial edges 150 and 150' of the upper 100. Such stretch resistant paths allow for the shoe including the upper 100 to be appropriately and sufficiently secured to a foot disposed therein. Further, the first to fifth portions 144*a*-144*e* and 144*a*'-144*e*' of the secure regions 144 and 144' may include additional strands and/or stitching to provide further support for materials of the upper 100 to be secured to a foot disposed therein.

The first portions 144*a* and 144*a*' of the secure regions 144 and 144' may be formed or disposed in the midfoot region 182 of the upper 100 and may be formed or disposed behind or on a heel-side of an area corresponding to an area in which a ball of a foot disposed in a shoe including the upper 100 is located. And, the fifth portions 144*e* and 144*e*' of the secure regions 144 and 144 may be formed or disposed in the midfoot region 184 and/or the heel region 186 between the cuff region 122 and the lateral and medial edges 150 and 150' of the upper 100, respectively.

The secure region 146 may be formed or disposed in the heel region 184 and may be formed or disposed adjacent to the fifth portions 144*e* and 144*e*' of the secure regions 144 and 144. Although described as a separate region or area, the secure region 146 and the fifth portions 144*e* and 144*e*' of the secure regions 144 and 144' need not be physically separate and may be contiguous and/or continuous. The secure region 146 may extend between the fifth portion 144*e* of the secure region 144 on the lateral side of the upper 100 around the heel portion 186 of the upper 100 and the fifth portion 144*e*' of the secure region 144' on the medial side of the upper 100. The stretch resistance of the secure region 146 about the heel region 186 of the upper 100 provides for tight and sufficient securing of the shoe including the upper 100 to a foot disposed therein. Further, although not show, the secure portion 146 may include additional support, which will be described herein.

Further, the secure region 146 may farther along the lateral edge 150 of the upper 100 than along the medial edge 150' of the upper 100. Such asymmetric heel provides greater stiffness due to the secure region 146 along the lateral edge 150 to better secure the heel of a foot disposed in a shoe including the upper 100 when the wearer of the shoe including the upper 100 is performing, for example, climbing maneuvers.

The active regions 130, 132, 132', 134, and 134' and the secure regions 140, 142, 144, 144', and 146 may, within each, include portions corresponding to higher or lower resistance to stretching. For example, the active region 130 disposed in the toe box of the upper 100 may include a first portion 130*a* and a second portion 130*b* having different degrees of resistance to stretching. Specifically, the first portion 130*a* of the active region 130 may have a lesser resistance to stretching than the second portion 130*b* of the active region 130 such that the upper 100 may have a variation in resistance to stretching in a direction from the lateral edge 150 to the medial edge 150' of the upper 100. However, aspects need not be limited thereto such that the active region 130 may be of one or of a constant resistance to stretching.

Further, in conjunction with the secure region 140 disposed about a lower portion of the toe box of the toe region 180 of the upper 100, the toe box may provide a decreasing resistance to stretching from the secure region 140 in the lower portion of the toe box of the toe region 180 of the upper 100 to the second portion 130*b* of the active region 130 to the first portion 130*a* of the active region 130 such that the stretching along the transverse direction has a variable resistance, which may be designed for both comfort and support.

As shown in FIG. 2, the lateral edge 150 of the upper 100 has a generally curved shape from the toe region 180, through the forefoot region 182 and the midfoot region 184, to the heel region 186. Further, as shown in FIG. 3, the medial edge of 150' of the upper 100 has a generally curved shape from the toe region 180, through the forefoot region 182 and the midfoot region 184, to the heel region 186. In other words, the upper 100, and a shoe including the upper 100, may have a concave shape throughout the toe region 180, the forefoot region 182, the midfoot region 184, and the heel region 186. The curved shape of the medial edge 150' of the upper 100 may have a curvature greater than a curvature of the curved shape of the lateral edge 150 of the upper 100. Further, the curved shape of the medial edge 150' may be longer than the curved shape of the lateral edge 150 of the upper 100, at least in part, due to the asymmetry of the secure region 146 about the heel region 186. The concave shape of the upper 100, and a shoe including the upper 100, may have a lesser concave shape appropriate for less aggressive climbing, while the concave shape of the upper 100, and a shoe including the upper 100, may have a more aggressive concave shape appropriate for more aggressive climbing.

Figure 5:
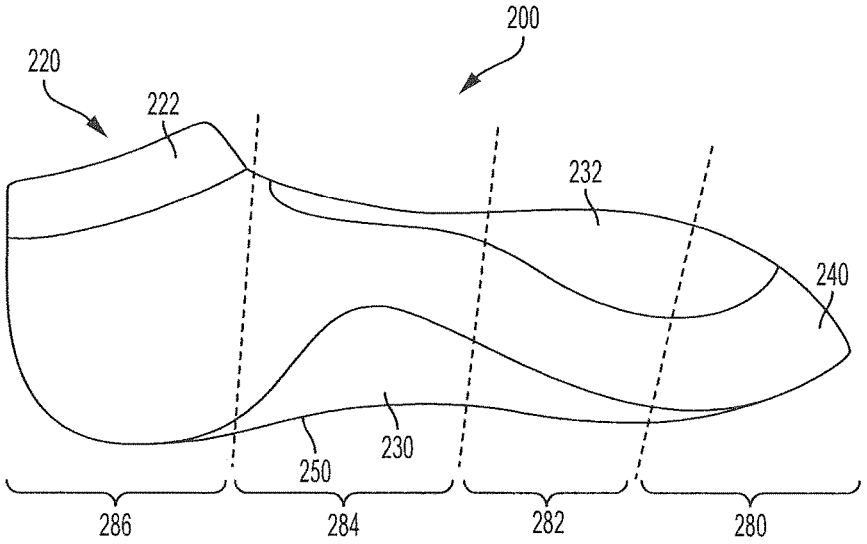
FIG. 5 is a side view of an upper for article of footwear according to aspects of the present invention.
Figure 6:
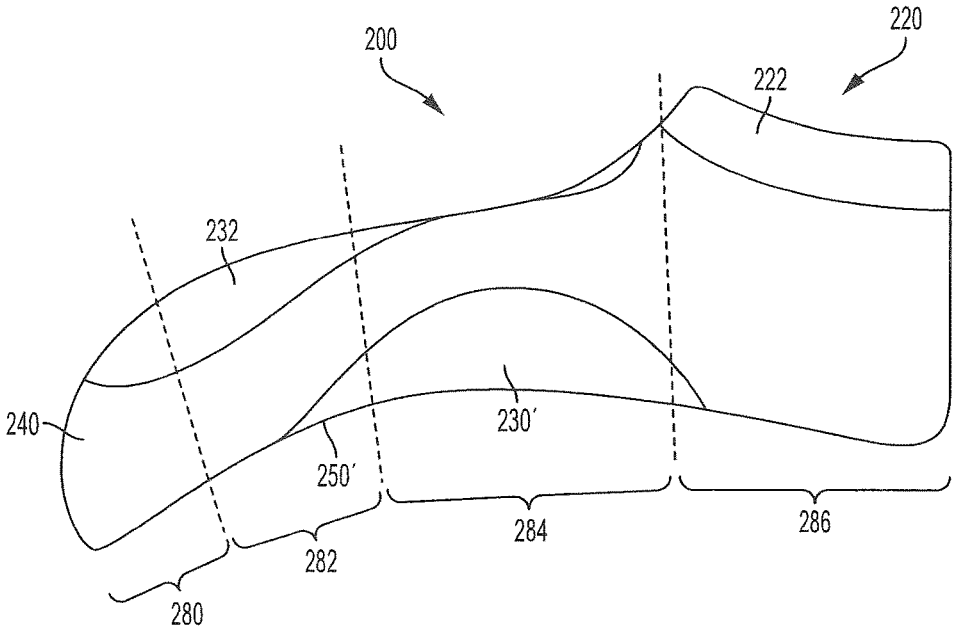
FIG. 6 is a side view of an upper for article of footwear according to aspects of the present invention.
Figure 7:
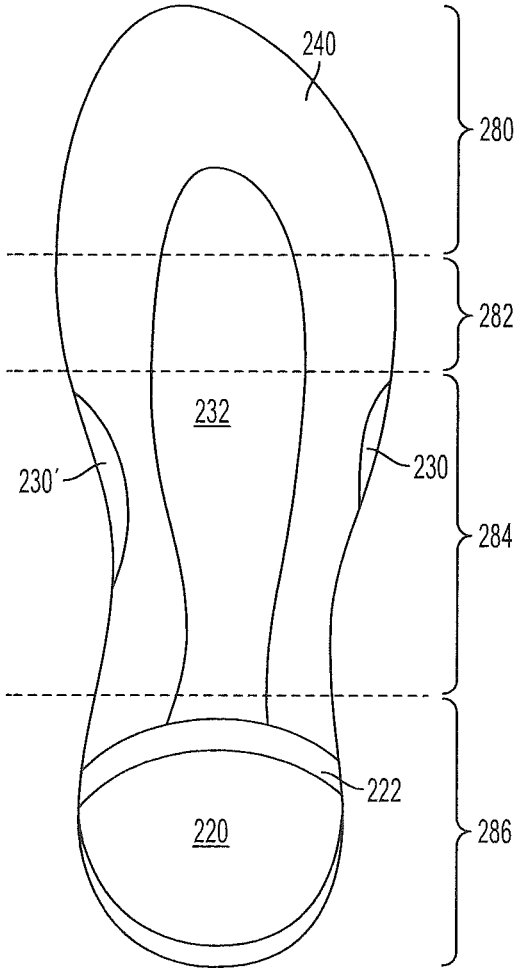
FIG. 7 is a top view of an upper for article of footwear according to aspects of the present invention.

FIG. 5 is a side view of an upper for article of footwear according to aspects of the present invention. FIG. 6 is a side view of an upper for article of footwear according to aspects of the present invention. FIG. 7 is a top view of an upper for article of footwear according to aspects of the present invention. FIG. 5 is, more specifically, a lateral side view of an upper for an article of footwear for a right foot, and FIG. 6 is, more specifically, a medial side view of an upper for an article of footwear for a right foot. It should be understood that aspects described herein are equally applicable to articles of footwear shaped for left feet and shaped for right feet.

FIGS. 5, 6, and 7 illustrate an upper 200 for a shoe according to aspects of the present invention. Similar to the upper 100 described herein, the upper 200 may be formed as a one-piece upper and may have one or fewer seams in which one or more pieces of textile come together to be attached via sewing or bonding. For example, the upper 200 may be formed of a textile to have a bootie construction or a sock-like construction. The bootie construction or the sock-like construction may be a knit construction formed via circular knitting, for example, by a circular knitting machine. Or, for example, the upper 200 may be knitted to form a unitary upper to wrap from a heel region, along a medial region, about a toe region, along a lateral region, and to the heel region again to be joined in the heel region by one seam. Further, the upper 200 may be of a unitary construction and include more than one seam. The upper 200 may be one piece and include stitching to connect different portions of the upper 200 to the upper 200, for example, when a portion of the upper 200 overlaps another portion of the upper 200. Aspects of the present invention provide for the upper 200 to be of knitted construction, which substantially increases breathability of the shoe including the upper 200 with respect to the materials of the uppers of the related art. Such increased breathability decreases the incidence of smell of the shoe including the upper 200.

Further, the upper 200 may be made or knit from different yarns or threads including, for example, nylon, polyester, thermoplastics, hot melt yarn, and the like. For example, the upper 200 may be 52-60% polyester, 20-28% nylon, and 16-24% hot melt yarn by mass.

As shown in FIGS. 5, 6, and 7, similar to the upper 100 described herein, the upper 200 includes a toe region 280, a forefoot (ball) region 282, a midfoot (arch) region 284, and a heel region 286. The upper 200 forms a toe box to house toes of a foot disposed in the upper 200 in the toe region 280. The forefoot region 282 is disposed between the toe region 280 and the midfoot region 284 and generally corresponds to a portion of a foot disposed in a shoe including the upper 200 in which the toes join the rest of the foot. In other words, the forefoot region 182 corresponds, generally, to a portion of the upper 200 in which the metatarsophalangeal articulations of a foot disposed in a shoe including the upper 200 are located. The forefoot region 282 may include an region corresponding to a location of the ball of a foot disposed in the upper 100, and a boundary between the toe region 180 and the forefoot region 282 may be at or about a toe-side of the ball of a foot disposed in the upper 200.

The midfoot region 284 is disposed between the forefoot region 282 and the heel region 286 and generally corresponds to a portion of the upper 200 in which an arch of a foot disposed in a shoe including the upper 200 is located. The heel region 286 of the upper 200 is disposed adjacent to the midfoot region 284 and at an opposite end of the upper 200 from the toe region 280 in a lengthwise direction of the upper 200.

The upper 200 includes an opening 220, which is bound by a cuff region 222. The cuff region 222 may be an active region elastically stretchable or having a relatively lower resistance to stretch to allow for a foot to be disposed therethrough to enter a shoe having the upper 200 as well as to return to a previous shape of the cuff region 222 to aid in securing the upper 200 of the shoe to the foot disposed therein. The cuff region 222 may have a greater ability to stretch than other active regions of the upper 200.

Similar to the upper 100 describe herein, the upper 200 includes active regions and a secure region. Specifically, the upper 200 includes active regions 230, 230', and 232 and a secure region 240. In upper 200, the secure region 240 may be a continuous area disposed about the entirety of the upper 200. For example, the secure region 240 may extend from the heel region 286, along the lateral side of the upper 200 as shown in FIG. 5, about the toe box and the toe region 280, along the medial side of the upper 200 as shown in FIG. 6, and to the heel region 286. The secure region 240 may have zero seams, for example, if the upper 200 is circular knitted. Or, the secure region 240 may include one seam to connect two portions of the single, unitary upper 200.

As shown in FIG. 5, the secure region 240 may include a majority of the heal region 286 to provide support for and securing of a heel of a foot disposed in a shoe including the upper 200 when the wearer engages in, for example, climbing maneuvers. The secure region 240 extends along the lateral side of the upper 200 into the midfoot region 284 and decreases in width so as to provide area available for the placement of the active region 230 adjacent to a lateral edge 250 of the upper 200. In the forefoot region 282, the secure region 240 may remain about a same width as in the midfoot region 284 but is formed or disposed closer to the lateral edge 250 of the upper 200. In and about the toe region 280, the secure region 240 may have a greater width so as to provide more protection and support to the toes of a foot engaged in, for example, climbing maneuvers.

In the forefoot region 282 along the medial side of the upper 200, as shown in FIG. 6, the secure region 240 may have a decreased width relative to the width of the secure region 240 in the toe region 280. Further, in the forefoot region 282, the secure region 240 may remain formed or dispose adjacent to the medial edge 250'. In the midfoot region 284, the secure region 240 is formed or disposed away from the medial edge 250' so as to provide area in which the active region 230' is formed adjacent to the medial edge 250'. In the heel region 286 in the medial side of the upper 200, the secure region 240 includes most of the heel region 286 so as to provide appropriate support and security for a heel of a wearer. Further, the secure region 240 may extend along the lateral edge 250 adjacent to the lateral edge 250 for a greater length than the secure region 240 extends along the medial edge 250' adjacent to the medial edge 250' to provide an asymmetric heel according to aspects of the present invention.

The secure region 240 may have a curved shape from the heel region 286 through the midfoot region 284 along both the lateral and medial sides of the upper 200.

As the secure region 240 is adjacent to the lateral edge 250 and the medial edge 250' in the forefoot region 282 and the toe region 280 of the upper 200, area is available for the active region 232 to be formed or disposed along a top of the upper 200 in the forefoot region 282 and the toe region 280 of the upper 200 as shown in FIG. 7. In the midfoot region 284, the active region 232 is decreased in width relative to the width of the active region 232 in the forefoot region 282. And, adjacent to the cuff region 222, the active region 232 may have an increased width relative to the active region 232 in the midfoot region 284.

The active region 230 may be formed or disposed in the midfoot region 284 adjacent to the lateral edge 250 of the upper 200. Similarly, the active region 230' may be formed or disposed in the midfoot region 284 adjacent to the medial edge 250' of the upper 200.

In the toe region 280 of the upper 200, the secure region 240 provides for protection and support of the toes of a foot disposed in the upper 200. The active region 232 in the toe region 280 and the forefoot region 282 provide for stretching in a transverse, e.g., medial to lateral, direction. For example, the active region 232 may provide for a decreased resistance to stretching or allows for stretching across and above a foot disposed in the upper 200 along at least the transverse direction between the lateral edge 250 and the medial edge 250' of the upper 200 at about the toe-side of the ball of a foot disposed in the upper 200, i.e., the area of the upper 200 commonly referred to as the knuckle box may be elastically stretchable to accommodate an increased height of a foot disposed therein in a high tension state.

In the midfoot region 284, the active regions 230, 230', and 250 may provide for further stretching of the upper 200 in a transverse direction of the upper 200, generally perpendicular to the longitudinal direction of the upper 200. The stretching of the upper 200 in the transverse direction provides for a comfortable fit when a wearer of the upper 200 as part of a shoe transitions the foot from a low tension state, to a medium tension state, and/or from a medium tension state to a high tension state as the upper 200 of the shoe remains supportive but allows for a relatively increased height of the foot within the upper 200. Further, in the midfoot region 284, the secure region 240, being relatively high on a foot disposed in the upper 200, provides support for the top of the foot during climbing maneuvers. Further, because the curvature of the secure region 240 in the midfoot region, the active regions 230 and 230' are free to stretch to allow for comfort for the wearer when the foot is in a low tension state.

Figure 8:
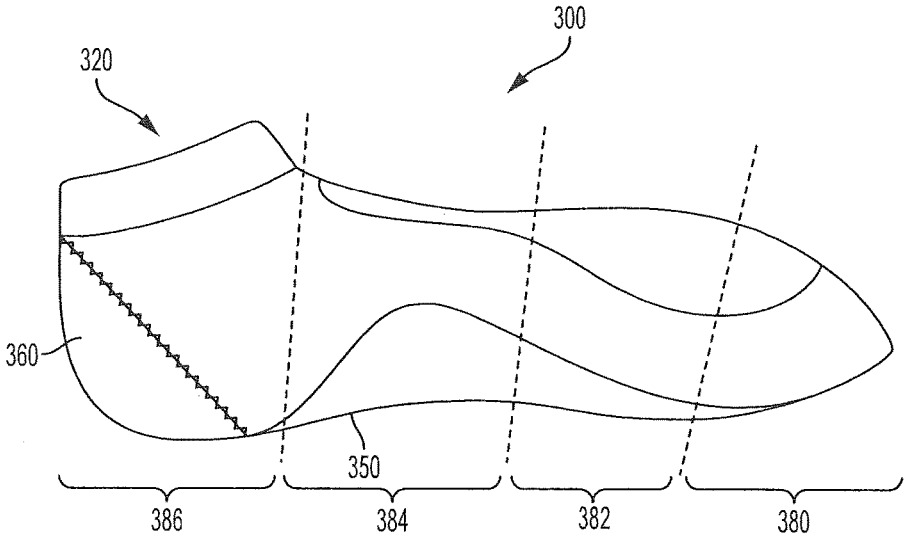
FIG. 8 is a side view of an upper for article of footwear according to aspects of the present invention.
Figure 9:
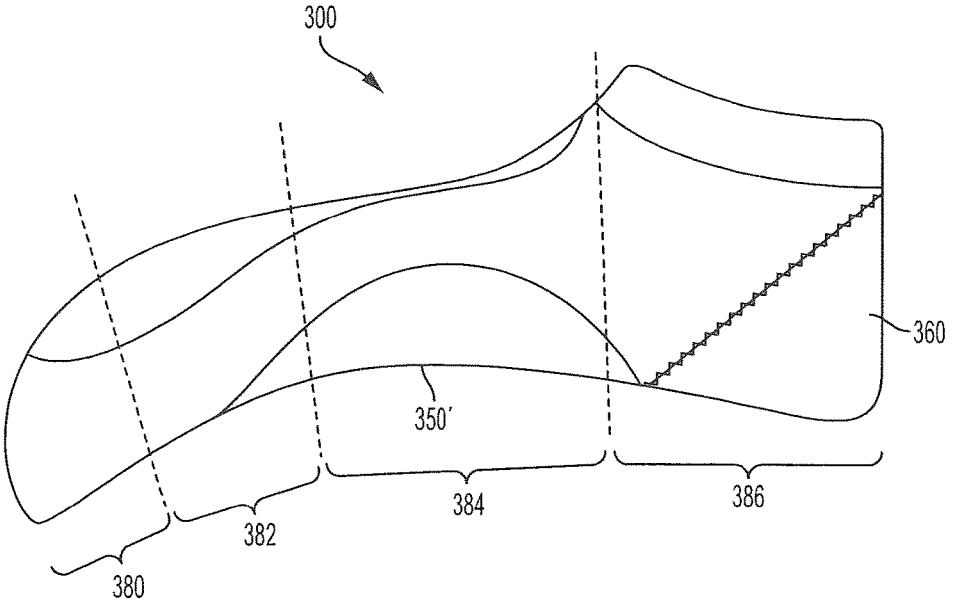
FIG. 9 is a side view of an upper for article of footwear according to aspects of the present invention.

FIG. 8 is a side view of an upper for article of footwear according to aspects of the present invention. FIG. 9 is a side view of an upper for article of footwear according to aspects of the present invention. FIG. 8 is, more specifically, a lateral side view of an upper for an article of footwear for a right foot, and FIG. 9 is, more specifically, a medial side view of an upper for an article of footwear for a right foot. FIGS. 8 and 9 illustrate an upper 300 similar to the upper 200 described herein, and the description of like elements is omitted.

Similar the upper 200 described herein, the upper 300 includes a toe region 380, a forefoot (ball) region 382, a midfoot (arch) region 384, and a heel region 386. The upper 300 includes a heel counter 360 to provide additional support and securing of the heel of a foot disposed in the upper 300. Specifically, the heel counter 360 extends from a lateral edge 350 up towards an opening 320 through which a foot is insertable into the upper 300 as shown in FIG. 8. The heel counter 360 extends about the heel region 386 and down to a medial edge 350' in the heel region 386 of the upper 300 as shown in FIG. 9. The heel counter 360 may be formed of or include material similar to the material of the secure region 240 or may further include traditional heel counter materials, such as leather, rubber, polymer, and the like.

Figure 10:
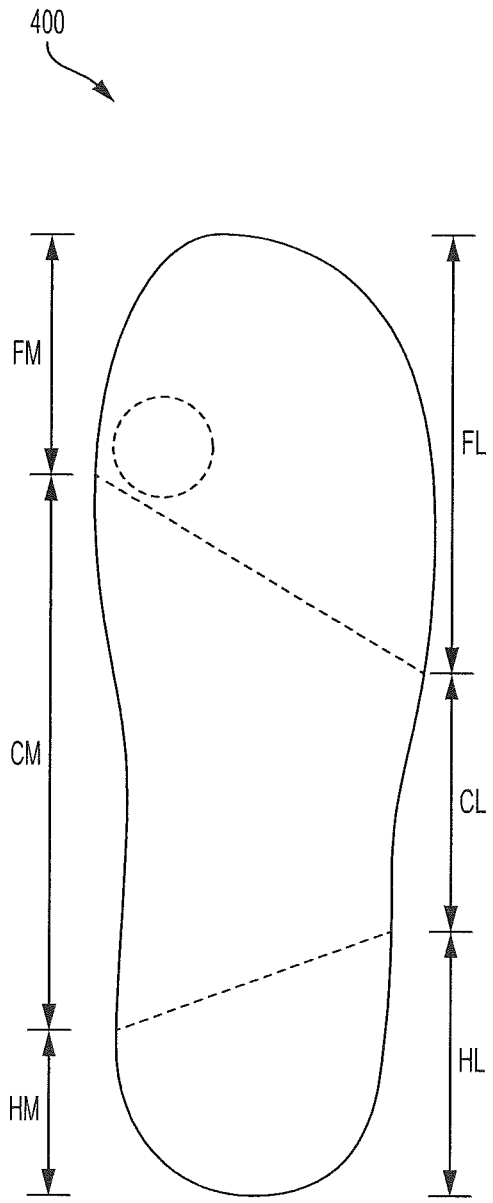
FIG. 10 is a schematic top view of an upper for article of footwear according to aspects of the present invention.

FIG. 10 is a schematic top view of an upper for article of footwear according to aspects of the present invention. FIG. 10 illustrates a shoe 400 having asymmetric heel, concavity, and toe lengths. As shown in FIG. 10 and described herein, the secure regions in the heel region may be asymmetric such that the secure region extends a greater heel length HL along the lateral side of the shoe 400 than the heel length HM along the medial side of the shoe 400, i.e., HL is greater than HM. Such asymmetric secure region of in the heel region provides superior support for climbing maneuvers, for example. Similarly, the concavity of the shoes and uppers is asymmetric having a greater length of concavity CM along the medial side of the shoe 400 than the length of concavity CL along the lateral side of the shoe 400, i.e., CM is greater than CL. Such a greater length of concavity CM may allow for more power to be applied to an inside edge be allowing the foot to be held in a more powerful position. A representative ball of a foot disposed in the shoe 400 is indicated by a dashed circle. Further, the greater forefoot length FL along the lateral side of the shoe 400 than the forefoot length FM along the medial side of the shoe 400 may allow for more area of contact to be made with a surface when climbing in a traditionally weaker part of the foot.

Although described herein as having relative elasticities, flexibilities, resistances to stretching, bending, twisting, and the like, the active regions and secure regions may be generally less elastic and/or flexible, and/or more resistant to stretching, bending, twisting, and the like than common knitting associated with the related art, such that the upper, according to aspects of the present invention, may maintain a shape better than the common knitting associated with the related art. Further, the active regions and the secure regions as described herein need not exhibit each of the described properties in combination but may include only one of the described relative properties. For example, the active regions may be distinguished by breathability and have a similar flexibility to the secure regions or vice versa.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An article of footwear, comprising:

a sole structure comprising at least an outsole and having a concave shape; and an upper secured to the sole structure comprising a textile comprising a first active region and a secure region, the first active region being between a lateral side of the upper and a medial side of the upper at least in an area of the upper at a toe side of an area configured to correspond to a ball of a foot disposed in the article of footwear, wherein the first active region is elastically stretchable in at least one direction, wherein the secure region is formed or disposed about a heel region of the upper and has a greater stretch-resistance than the first active region, wherein the upper is a unitary and circular knitting textile upper, wherein the upper further comprises a tongue portion at a top portion of the upper, and the tongue portion comprises a tongue active region elastically stretchable in at least a transverse direction of the article of footwear, wherein the first active region comprises a first portion having a first elastic stretchability and a second portion having a second elastic stretchability, the first elastic stretchability and the second elastic stretchability being different, wherein the first and second portions are disposed about the toe side of the area configured to correspond to the ball of the foot disposed in the article of footwear, neither the first portion nor the second portion extending into a midfoot region or the heel region of the article of footwear.

2. The article of footwear of claim 1, wherein the upper further comprises a second active region at the lateral side of the article of footwear and a third active region at the medial side of the article of footwear.

3. The article of footwear of claim 2, wherein the second active region at the lateral side and the third active region at the medial side each extend in a direction between the sole structure and a top portion of the upper and are elastically stretchable in a longitudinal direction of the article of footwear.

4. An article of footwear, comprising:

a sole structure comprising at least an outsole and having a concave shape; and an upper secured to the sole structure comprising a textile comprising a first active region and a secure region, the first active region being between a lateral side of the upper and a medial side of the upper at least in an area of the upper at a toe side of an area configured to correspond to a ball of a foot disposed in the article of footwear, wherein the upper is a unitary and circular knitting textile upper, wherein the secure region comprises one continuous area formed or disposed over an entire length of the upper, wherein the upper further comprises a second active region in the midfoot region of the lateral side of the upper and a third active region in the midfoot region of the medial side of the upper, the second and third active regions being surrounded by the secure region, wherein the first, second and third active regions are elastically stretchable in at least one direction, wherein the first active region comprises a first portion having a first elastic stretchability and a second portion having a second elastic stretchability, the first elastic stretchability and the second elastic stretchability being different, wherein the first and second portions are disposed about the toe side of the area configured to correspond to the ball of the foot disposed in the article of footwear, neither the first portion nor the second portion extending into a midfoot region or the heel region of the article of footwear.

5. The article of footwear of claim 4, wherein the continuous area of the secure region extends farther along a lateral edge of the lateral side of the upper than along a medial edge of the medial side of the upper.

6. The article of footwear of claim 5, wherein, in a midfoot region of the upper, the continuous area of the secure region is formed or disposed toward a top portion of the upper on both the lateral and medial sides of the upper.

* * * * *